US007878139B1

(12) United States Patent
Karnes et al.

(10) Patent No.: US 7,878,139 B1
(45) Date of Patent: Feb. 1, 2011

(54) UNIVERSAL AUTOMOBILE FLAG

(75) Inventors: Luther McKinley Karnes, Fort Gibson, OK (US); Brian Joe Karnes, Fort Gibson, OK (US); Roy Jeffery Lashley, Muskogee, OK (US)

(73) Assignee: GameDay, LLC, Muskogee, OK (US)

( * ) Notice: Subject to any disclaimer, the term of this patent is extended or adjusted under 35 U.S.C. 154(b) by 118 days.

(21) Appl. No.: 12/332,512

(22) Filed: Dec. 11, 2008

(51) Int. Cl.
*G09F 17/00* (2006.01)
*G09F 21/04* (2006.01)

(52) U.S. Cl. ..... 116/28 R; 116/173; 116/DIG. 24

(58) Field of Classification Search ..... 116/28 R, 116/173, DIG. 24; 40/591, 592; 248/514, 248/521, 537, 538, 539, 467; D11/166, 181, D11/182
See application file for complete search history.

(56) References Cited

U.S. PATENT DOCUMENTS 2,856,814 A * 10/1958 Dillmann ..... 248/467
3,036,545 A 5/1962 Legg
3,563,200 A * 2/1971 Grossman ..... 116/28 R
3,715,821 A 2/1973 Hawes
3,762,360 A 10/1973 Hawes
3,791,336 A * 2/1974 Zdebski ..... 116/28 R
D248,284 S 6/1978 Bowser
4,455,006 A * 6/1984 Aaserude ..... 248/205.6
4,590,883 A * 5/1986 Steed et al. ..... 116/173
D293,659 S 1/1988 Griffin
D306,396 S * 3/1990 Brushaber ..... D8/355
4,976,410 A 12/1990 Tomaiuolo
5,042,418 A * 8/1991 Hoover et al. ..... 116/173
D322,413 S 12/1991 Castillo
5,233,938 A 8/1993 Lalo
5,339,551 A * 8/1994 Elmer ..... 40/591
D359,924 S 7/1995 Grumbeck
D363,249 S 10/1995 Castillo
D370,182 S 5/1996 Marvis et al.
5,524,857 A * 6/1996 Eisenberg et al. ..... 248/535
5,692,331 A * 12/1997 Tipke ..... 40/591
5,974,711 A * 11/1999 Tipke ..... 40/591
D421,238 S * 2/2000 Dinsky ..... D11/182
6,085,687 A 7/2000 Chester
D438,820 S * 3/2001 Goulding ..... D11/166

(Continued)

FOREIGN PATENT DOCUMENTS

DE 29722733 U1 * 6/1998

(Continued)

*Primary Examiner*—R. A. Smith
(74) *Attorney, Agent, or Firm*—Head, Johnson & Kachigian, P.C.

(57) ABSTRACT

A flagpole comprising a clip portion, where the clip portion is shaped such that it fits over the top of an automobile window and allows the flagpole to be held in place by the window and an associated window frame when the window is nearly in a rolled up position; a u-shaped portion extending generally downward from the clip portion, away from the clip portion, and then upward, such that the u-shaped portion extends around a vent visor or rain guard associated with the window, where the vent visor or rain guard need not be in use on the window when the flagpole is in use; a straight portion extending upward from the u-shaped portion; and a flag situated on the straight portion. The flagpole may also be adjustable such that it may be used on a trunk deck.

4 Claims, 6 Drawing Sheets

U.S. PATENT DOCUMENTS

| | | | | |
|---|---|---|---|---|
| 6,276,080 | B1 * | 8/2001 | Brennan | 40/591 |
| 6,637,365 | B1 | 10/2003 | Adamski | |
| D496,878 | S | 10/2004 | Howard et al. | |
| 7,066,105 | B2 | 6/2006 | Tal | |
| 7,290,362 | B1 * | 11/2007 | Passmore et al. | 40/591 |
| 2003/0019998 | A1 * | 1/2003 | Kou | 248/534 |
| 2004/0221498 | A1 * | 11/2004 | Vico et al. | 40/593 |
| 2005/0217557 | A1 | 10/2005 | Caetano et al. | |
| 2007/0283877 | A1 * | 12/2007 | Durkin | 116/209 |

FOREIGN PATENT DOCUMENTS

| | | | |
|---|---|---|---|
| DE | 19857427 | A1 * | 6/2000 |
| GB | 2124008 | A * | 2/1984 |
| GB | 2270185 | A * | 3/1994 |

* cited by examiner

UNIVERSAL AUTOMOBILE FLAG

FIELD OF THE INVENTION

This invention relates generally to automobile flags, and more particularly to automobile flags that may be used on all automobiles, either on a trunk lid or on a window, including those with window vent visors.

DESCRIPTION OF THE RELATED ART

Adorning vehicles with flags, particularly American flags and flags supporting sports teams, is common. One popular method of attaching a flag to a vehicle is using a window-supported flagpole. However, such flagpoles cannot be used on windows that have window vent visors or rain guards. Furthermore, such flagpoles are not adaptable for use on a trunk lid.

A typical window-supported flagpole has a clip that fits over the top of an automobile window and is held in place by the window frame when the window is nearly in the rolled-up position. Thus, a user rolls down their window, places the clip over the top of the window, and then rolls up the window until the flagpole is secured, with the clip wedged between the window and the window frame. The flagpole then extends directly up from the clip.

Vehicles equipped with window vent visors or rain guards typically have a lip along the window frame at the top edge of each window, and often along the leading edge of front windows. The vent visor or rain guard may be several inches wide. This prevents rain, snow, dust, etc. from entering the vehicle when the window is partially down. However, it also prevents the use of typical window-supported flagpoles, as the vent visor or rain guard extends out over the area that a flagpole would normally extend upward.

Furthermore, even on cars without vent visors or rain guards, flags flown on such flagpoles frequently hit the car on which they are mounted, thus distracting the driver. Finally, such flagpoles are held in place only with the window and window frame and thus are not secure and will not stay in place if the window is rolled down.

Finally, typical window flags are not usable on trunk lids.

Accordingly, it would be desirable to provide a universal automobile window flag that may be used on all vehicles, including those with window vent visors or rain guards. It is further desirable to provide such a flagpole that situates the associated flag such that it does not hit the car on which it is mounted when in use. Further, it is desirable to provide such a flagpole that has a secondary means of securing the flagpole to the vehicle such that the flagpole stays in place when the window is rolled down. Finally, it is desirable for such a flagpole to be adaptable for use on a trunk lid.

SUMMARY OF THE INVENTION

In general, in a first aspect, the present invention relates to a flagpole comprising a clip portion, where the clip portion is shaped such that it fits over the top of an automobile window and allows the flagpole to be held in place by the window and an associated window frame when the window is nearly in a rolled up position; a u-shaped portion extending generally downward from the clip portion, away from the clip portion, and then upward, such that the u-shaped portion extends around a vent visor or rain guard associated with the window, where the vent visor or rain guard need not be in use on the window when the flagpole is in use; a straight portion extending upward from the u-shaped portion; and a flag situated on the straight portion.

The flagpole may further comprise a lip located between the u-shaped portion and the straight portion where the lip has a greater diameter than the straight portion such that the flag cannot slide down the flagpole past the lip and onto the u-shaped portion. The flagpole may further comprise a suction cup with a cup portion, where the suction cup is attached to the u-shaped portion of the flagpole below the clip portion in a section of the u-shaped portion extending generally downward from the clip portion, situated such that the cup portion of the suction cup may be removably attached to the window when the clip portion is in place over the top of the window.

The clip portion may be generally rectangular with a u-shaped profile. The u-shaped portion may narrow down from nearly the width of the clip portion immediately adjacent the clip portion to nearly the width of the straight portion. The u-shaped portion may have a cross-section with an elongated octagonal shape, such that the cross-section has two parallel sides lying in a plane parallel to the window when the flagpole is in use on the window, two parallel sides lying in a plane perpendicular to the window, and four sides each connecting one of the sides parallel to the window to one of the sides perpendicular to the window, where the distance between the two sides perpendicular to the window is greater than the distance between the two sides parallel to the window.

The straight portion may have a round cross-section. The straight portion may be a sufficient distance from an automobile in which the window is located that the flag situated on the straight portion does not hit the automobile when in use. The straight portion may be narrower than the u-shaped portion, and may terminate in a rounded end. If the straight portion terminates in a rounded end, it may further comprise a radial groove adjacent the rounded end, and may further comprise a clip that may be snapped over the rounded end into the groove.

In an alternate embodiment, the flagpole comprises: a clip portion, where the clip portion is shaped such that it fits over the top of an automobile window or over the edge of an automobile truck deck, where the clip portion is generally rectangular and has a generally J-shaped cross section where the curved part of the J hooks over the window or trunk deck and the straight part of the J extends along the outside of the window or trunk deck, and where the clip portion has a back side facing the window or trunk deck and a front side opposite the back side; a suction cup with a cup portion attached to the back side of the clip portion and situated such that the cup portion of the suction cup may be removably attached to the window or trunk deck when the clip portion is in place over the window or trunk deck; a clip attachment piece extending from the front side of the clip portion; a straight portion terminating in a pole attachment piece, where the pole attachment piece is removably attached to the clip attachment piece; and a flag situated on the straight portion.

The clip attachment piece and the pole attachment piece may each have a plurality of teeth in a generally circular orientation, such that the teeth of the clip attachment piece may mate with the teeth of the pole attachment piece when the clip attachment piece and the pole attachment piece are in any one of a plurality of positions. The clip attachment piece and the pole attachment piece may each have a hole therethrough located approximately equidistant from each of the teeth thereon, where the hole in the pole attachment piece is threaded, and may further comprise a threaded post that fits through the hole in the clip attachment piece and is threadably receivable in the hole in the pole attachment piece, where the threaded post terminates in a tightening knob such that the threaded post may be placed through the hole in the clip attachment piece and threaded into the hole in the pole attachment piece to secure the clip attachment piece and the pole attachment piece to each other in a desired position. The straight portion may have an upper straight portion and a lower straight portion, further comprising a lip located between the upper straight portion and the lower straight portion where the lip has a greater diameter than the upper straight portion such that the flag, when positioned on the upper straight portion, cannot slide down the flagpole past the lip and onto the lower straight portion.

Other advantages and features will be apparent from the following description and from the claims.

DETAILED DESCRIPTION OF THE PREFERRED EMBODIMENTS

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
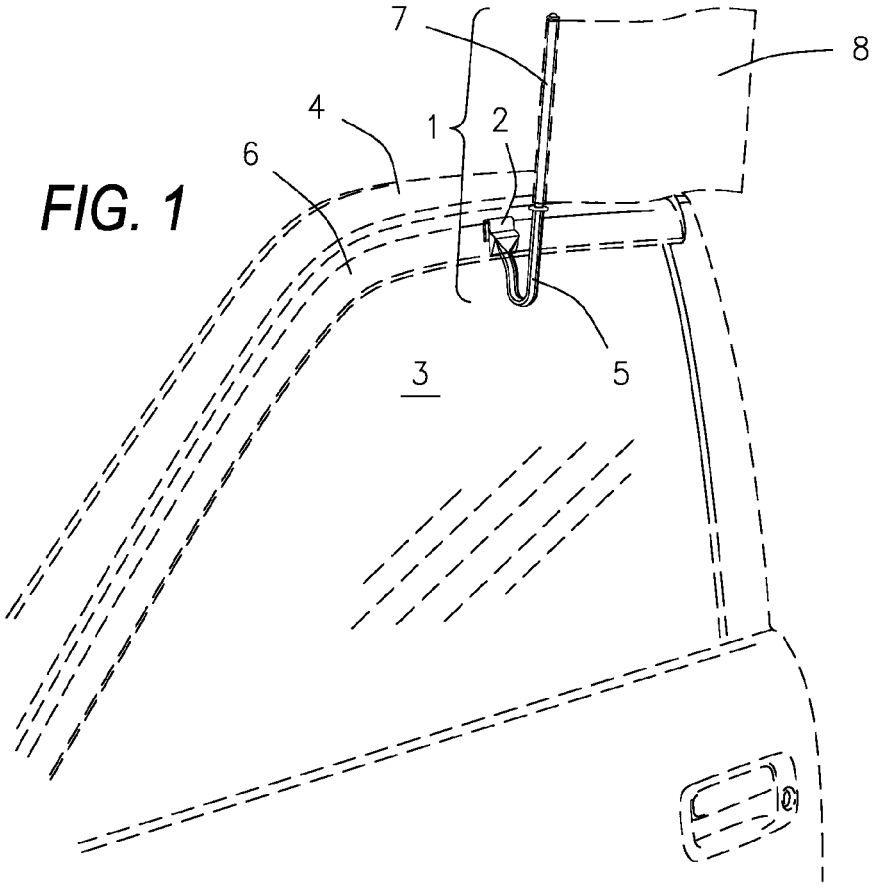
FIG. 1 is a perspective view of the flagpole mounted on an automobile window with a vent visor and flying a flag.

Referring to the figures of the drawings, wherein like numerals of reference designate like elements throughout the several views, FIG. 1 shows a universal automobile window flag. The flagpole 1 has a portion 2 that fits over an automobile window 3 such that the flagpole is held in place by the window 3 and window frame 4 when the window 3 is nearly rolled up. From this clip portion 2, the flagpole 1 extends generally downward before extending up, such that a U-shaped portion 5 is formed. This U-shaped portion 5 allows the flagpole 1 to be used on a window 3 with a window vent visor or rain guard 6, as it allows the flagpole 1 to extend around the vent visor or rain guard 6 before extending upward for flag display. The flagpole 1 may also be used on a window 3 without a window vent visor or rain guard. Adjacent the U-shaped portion 5 is a straight portion 7, to which a flag 8 attaches for display.

Figure 2:
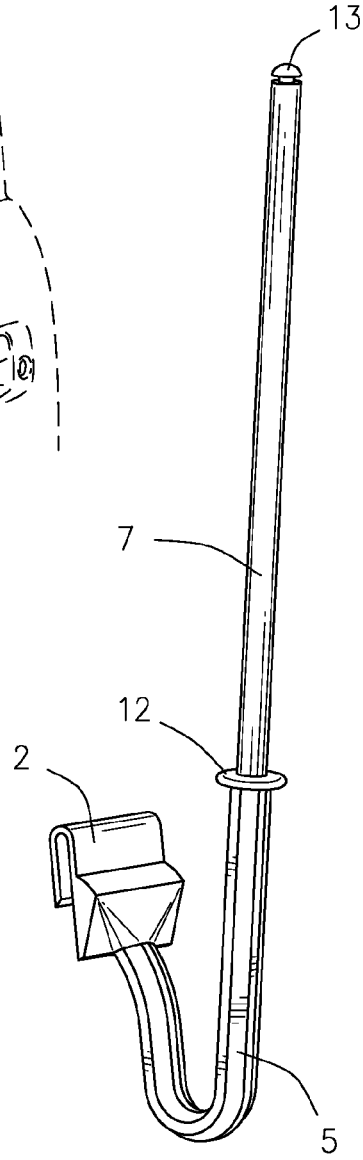
FIG. 2 is a perspective view of the flagpole.
Figure 3:
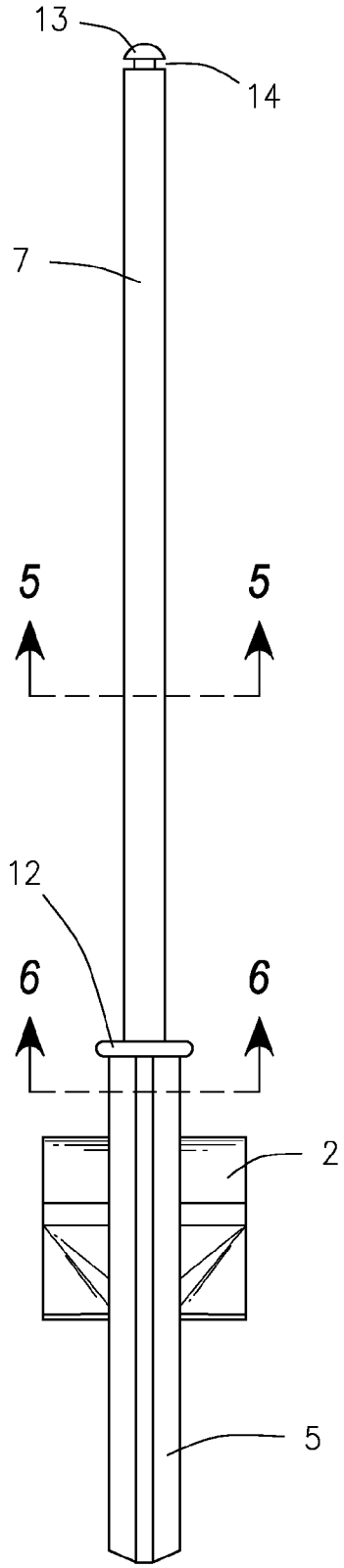
FIG. 3 is front view of the flagpole.
Figure 4:
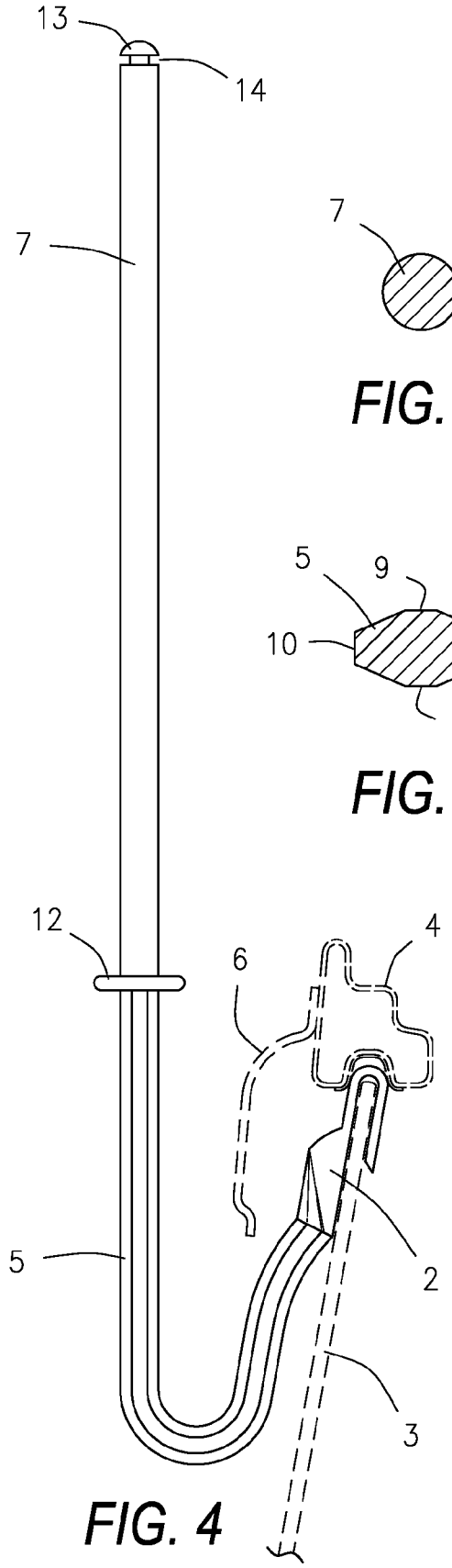
FIG. 4 is a side view of the flagpole, with a cross section of an automobile window with a vent visor shown in dashed lines to illustrate use of the flagpole.

As seen in FIGS. 2, 3, and 4, the clip portion 2 is generally rectangular with a U-shaped profile, like a square or other rectangle folded over itself with a small gap between the two sides of sufficient size to accommodate an automobile window 3. The U-shaped portion 5 of the flagpole 1 extends from the clip portion 2, and may narrow down from nearly the width of the clip portion 2 to nearly the width of the straight portion 7.

Figure 6:
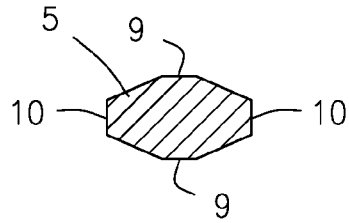
FIG. 6 is a cross section of the flagpole.

The U-shaped portion 5 may have an elongated octagonal shape, with the sides 9 lying in the plane parallel to the window 3 when the flagpole 1 is in use being longer than the sides 10 lying in the plane perpendicular to the window 3, as seen in FIG. 6. When in use, the side facing the direction of travel is a short side; thus, the elongated octagonal shape of the U-shaped portion 5 provides a low profile and thus reduces drag on the flagpole. The longer sides, lying parallel to the direction of travel, thus do not increase the drag but provide increased support to the flagpole. The U-shaped portion 5 may extend far enough down that, when in use on a window 3 with a vent visor or rain guard 6, it extends down further than the vent visor or rain guard 6, and then curves into a u-shape extending outward further out than the vent visor or rain guard 6 before extending upward.

Figure 7:
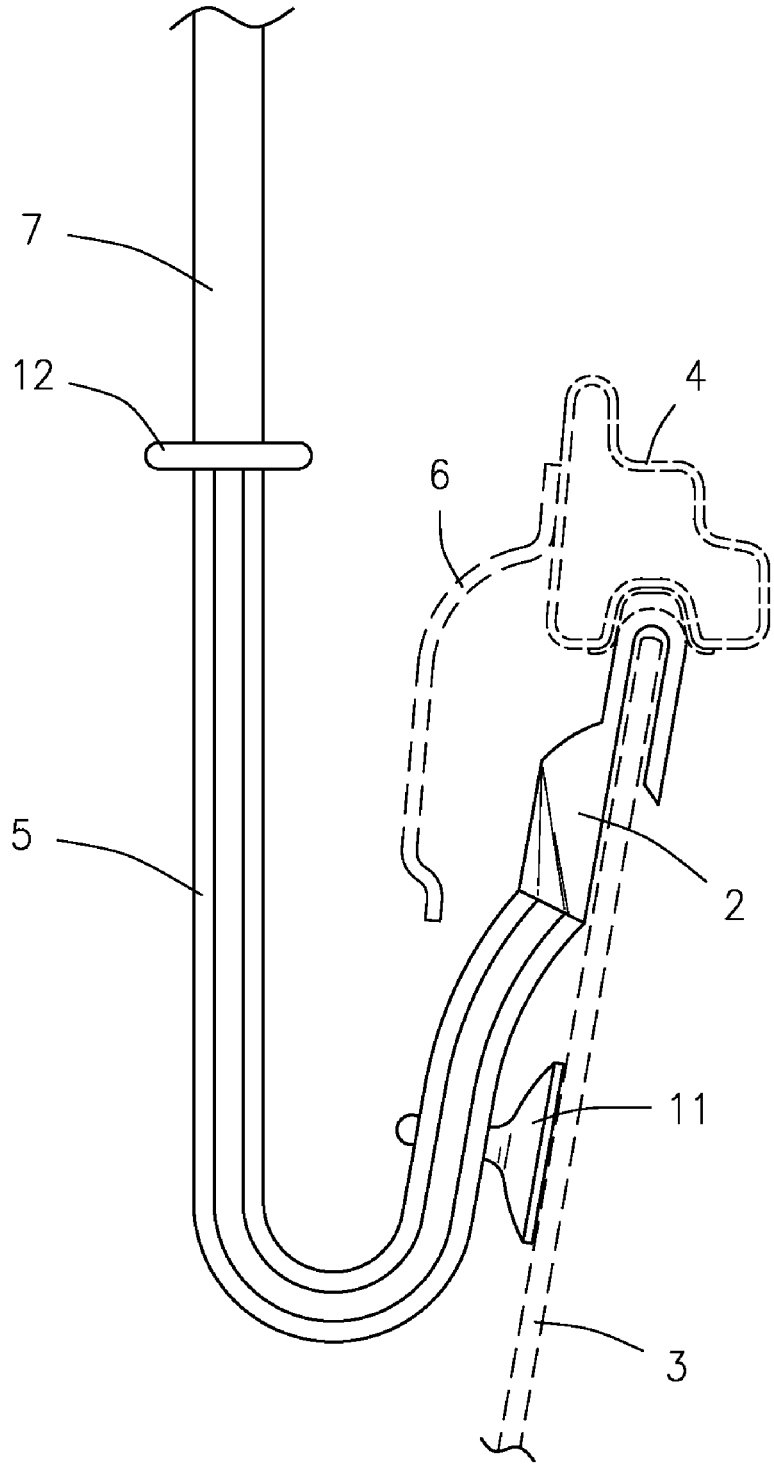
FIG. 7 is a side view of another example of the flagpole with a suction cup attached thereto, with a cross section of an automobile window with a vent visor shown in dashed lines to illustrate use of the flagpole.

A suction cup 11 may be attached to the downward extending portion of the U-shaped portion 5 such that the cup portion of the suction cup 11 may removably attach to the window 3 upon which the clip portion 2 has been placed when the flagpole 1 is in use, as seen in FIG. 7. This allows for an additional way of attaching the flagpole 1 to the window 3 and supporting the flagpole 1 other than the retention of the clip 2 between the window 3 and the window frame 4. Thus, the flagpole 1 stays in place even when the window 3 is rolled down. The suction cup 11 may have a pull-tab to release suction and aid in removal.

Figure 5:
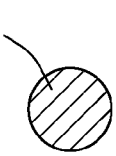
FIG. 5 is a cross section of the flagpole.

The straight portion 7 extends upward from the U-shaped portion 5. A flag 8 may be placed on the straight portion 7 for display. Because the U-shaped portion 5 extends outward as well as down, the straight portion 7 is located further away from the vehicle than a flagpole extending straight up from the clip portion 2 would be located. Therefore, a flag 8 placed on the straight section 7 is located further from the vehicle and is less likely to hit the vehicle when in use, thus reducing distractions to the driver. The straight portion 7 may have a round profile, as seen in FIG. 5, to allow for free movement of a flag 8 placed on the straight portion 7. The straight portion 7 may be narrower than the U-shaped portion 5, or may be of a similar width compared to the narrow sides 10 of the U-shaped portion 5, while being narrower than the wide sides 9 of the U-shaped portion.

A lip 12 may project radially outward from the flagpole 1 in between the U-shaped portion 5 and the straight portion 7. The lip 12 prevents a flag 8 placed on the straight portion 7 from sliding down the flagpole 1 onto the U-shaped portion 5. The straight portion 7 may terminate in a rounded end 13, and may have a radial groove 14 adjacent the rounded end 13. A clip (not shown) may snap over the rounded end 13 into the groove 14 to hold a flag 8 in place on the pole 1. Alternately, the straight portion 7 may terminate in a sphere (not shown). The sphere may or may not be removable from the flagpole 1. The sphere may prevent a flag 8 attached to the straight portion 7 from sliding off of the end of the flagpole 1. The flagpole 1 may further comprise a narrow section (not shown) immediately adjacent the sphere. A snap ring (not shown) may be clipped over the narrow section. Because the narrow section is narrower than the straight portion or the sphere, the snap ring cannot slide along or off of the flagpole and thus prevents movement of the flag along the flagpole. Alternately, the straight portion 7 may have a hole (not shown) at its terminal end into which a pin (not shown) may be inserted to prevent a flag 8 on the straight portion 7 from sliding off.

Figure 8:
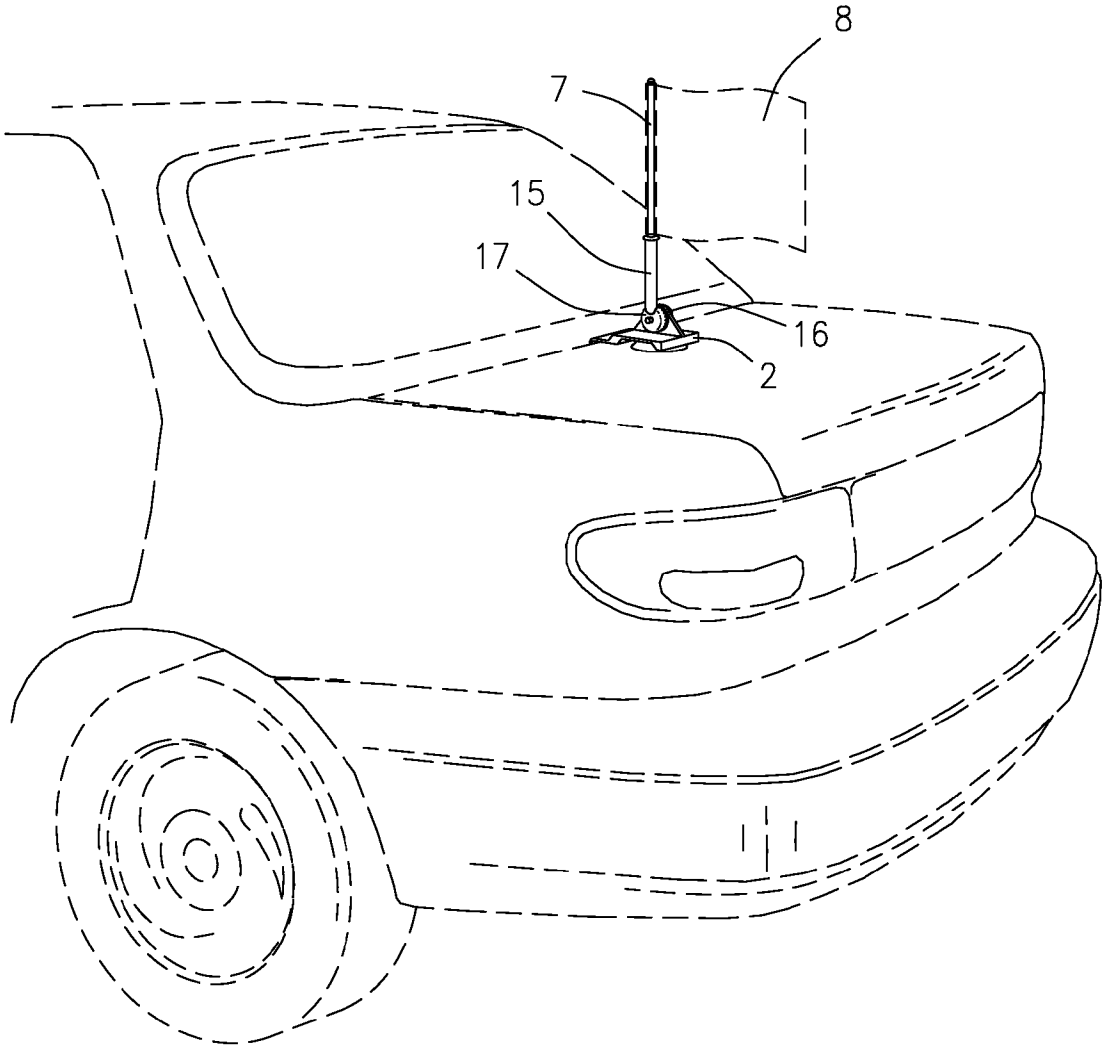
FIG. 8 is a perspective view of another example of the flagpole mounted on an automobile trunk deck.
Figure 9:
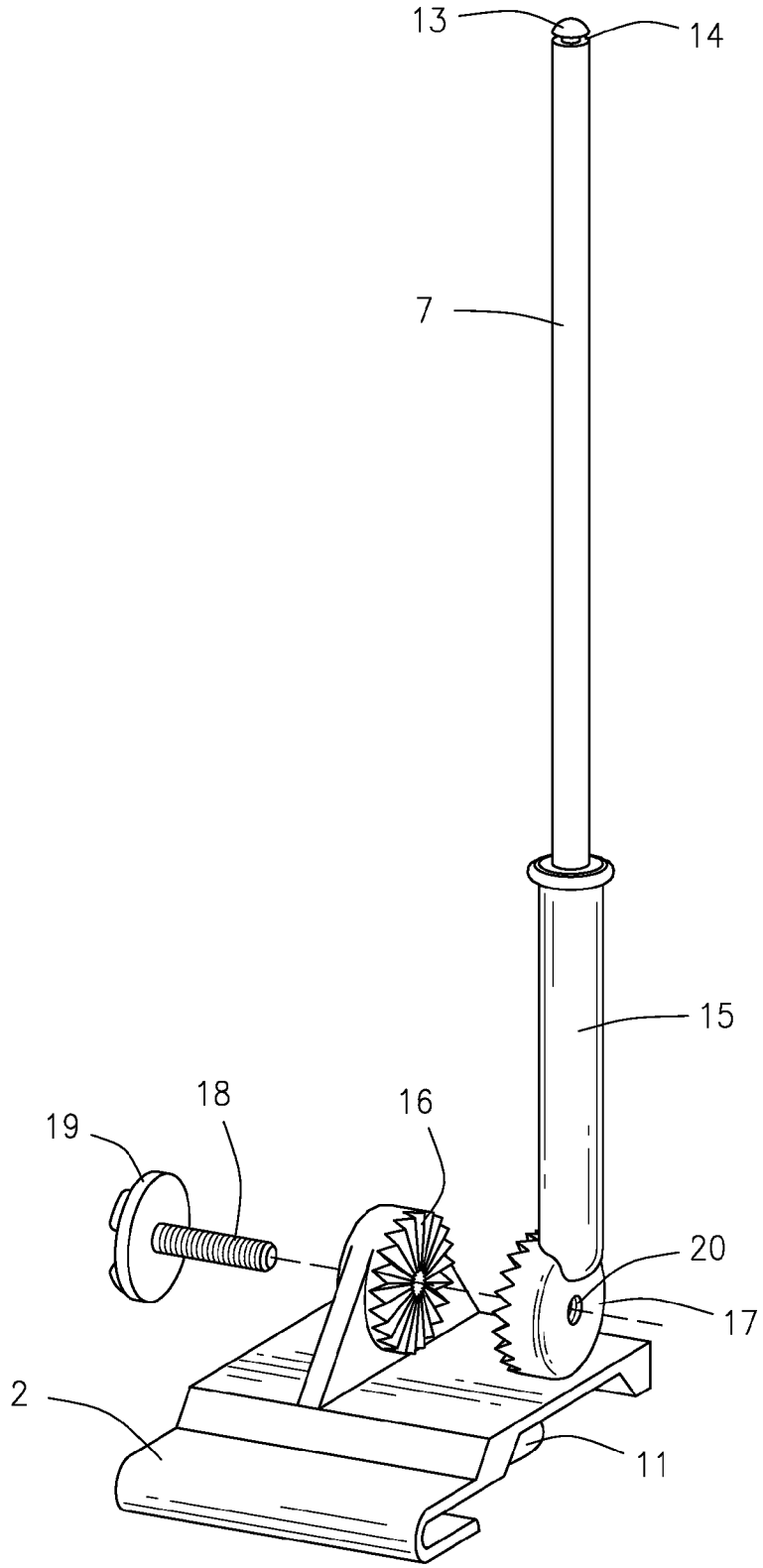
FIG. 9 is an exploded view of the other example of the flagpole with a suction cup and an adjustable angle pole portion.
Figure 11:
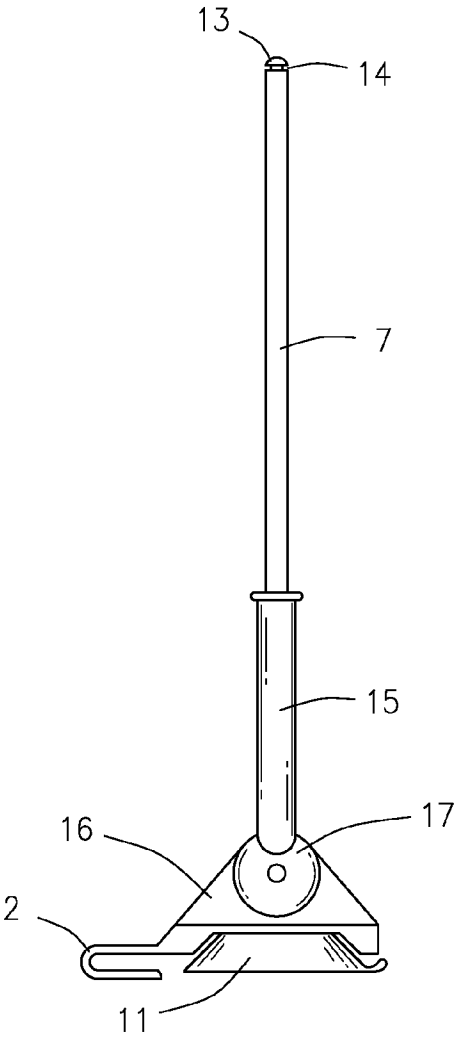
FIG. 11 is view of the other side of the other example of the flagpole.
Figure 10:
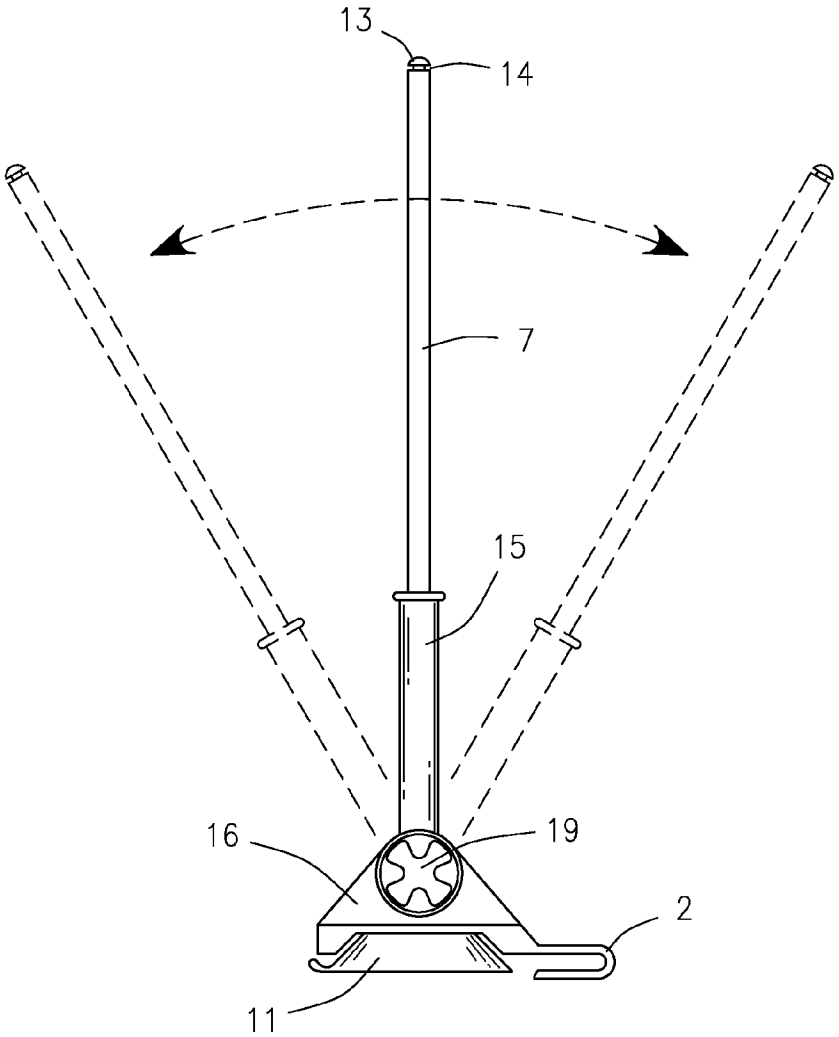
FIG. 10 is a side view of the other example of the flagpole.

FIGS. 8 through 11 illustrate another example of the universal automobile flag, where the flagpole is adjustable such that the angle between the clip portion 2 and the straight portion 7 may be changed. FIG. 10 illustrates several angles at which the flagpole may be used. In this example, the U-shaped portion is replaced with different elements adjacent the straight portion 7 and the clip portion 2. As seen in FIG. 9, a lower straight portion 15 extends downward from the straight portion 7 and terminates in a generally circular attachment end 17. Likewise, the clip portion 2 has its own attachment end 16 located on the side of the clip portion 2 opposite the side adjacent to a window when the flagpole is in use on a window, as well as suction cup 11 located on the side of the clip portion 2 adjacent to a window when the flagpole is in use on a window. The suction cup 11 may be seen in FIGS. 10 and 11.

Attachment end 16 and attachment end 17 each have a plurality of radially projecting teeth in a generally circular orientation such that the teeth of attachment end 16 mate with the teeth of attachment end 17. The teeth may be of consistent size and spacing such that they mate when attachment ends 16 and 17 are in a variety of relative positions. Thus, the angle between the straight portions 7 and 15 and the clip portion 2 may be adjusted by adjusting the relative positions of attachment ends 16 and 17. Once in the desired orientation, attachment ends 16 and 17 may be secured to each other via a threaded post 18 which threads through a smooth hole centered in attachment end 16 and a threaded hole 20 centered in attachment end 17, into which threaded post 18 is threadably receivable. Threaded post 18 may terminate in a tightening knob 19, whereby attachment ends 16 and 17 may be tightened against each other.

The adjustable flagpole not only allows the user to select the angle at which he or she wishes the flag to fly when mounted on a window, but also allows the flagpole to be displayed on a trunk lid, as seen in FIG. 8. The user may slide the clip portion 2 around the front edge of a car trunk deck and secure the flagpole by pressing the suction cup 11 against the trunk. The user may loosen the tightening knob 19 sufficiently to allow adjustment of the attachment ends 16 and 17, and thus the angle between the clip portion 12 and the straight portions 7 and 15. When the attachment ends are in the correct orientation, the user may then tighten the tightening knob 19 to secure the flagpole at the desired angle.

The flagpole 1 may be made of any suitable material, such as plastic. If made of plastic, the flagpole 1 may be made through plastic injection molding. The flagpole 1 may be made in several pieces or may be one unitary piece, not including the optional clip.

Whereas, the devices and methods have been described in relation to the drawings and claims, it should be understood that other and further modifications, apart from those shown or suggested herein, may be made within the spirit and scope of this invention.

What is claimed is:

1. A flagpole comprising:

a clip portion, where the clip portion is shaped such that the clip portion fits over the top of an automobile window or over the edge of an automobile truck deck, where the clip portion is generally rectangular and has a generally J-shaped cross section where the curved part of the J hooks over the window or trunk deck and the straight part of the J extends along the outside of the window or trunk deck, and where the clip portion has a back side facing the window or trunk deck and a front side opposite the back side;

a suction cup with a cup portion attached to the back side of the clip portion and situated such that the cup portion of the suction cup may be removably attached to the window or trunk deck when the clip portion is in place over the window or trunk deck;

a clip attachment piece extending from the front side of the clip portion;

a straight portion terminating in a pole attachment piece, where the pole attachment piece is removably attached to the clip attachment piece; and a flag situated on the straight portion.

2. The flagpole of claim 1 where the clip attachment piece and the pole attachment piece each have a plurality of teeth in a generally circular orientation, such that the teeth of the clip attachment piece may mate with the teeth of the pole attachment piece when the clip attachment piece and the pole attachment piece are in any one of a plurality of relative positions.

3. The flagpole of claim 2 where the clip attachment piece and the pole attachment piece each have a hole therethrough located approximately equidistant from each of the teeth thereon, where the hole in the pole attachment piece is threaded, and further comprising a threaded post that fits through the hole in the clip attachment piece and is threadably receivable in the hole in the pole attachment piece, where the threaded post terminates in a tightening knob such that the threaded post may be placed through the hole in the clip attachment piece and threaded into the hole in the pole attachment piece by turning the tightening knob to secure the clip attachment piece and the pole attachment piece to each other in a desired position.

4. The flagpole of claim 1 where the straight portion has an upper straight portion and a lower straight portion, further comprising a lip located between the upper straight portion and the lower straight portion where the lip has a greater diameter than the upper straight portion such that the flag, when positioned on the upper straight portion, cannot slide down the flagpole past the lip and onto the lower straight portion.

* * * * *